United States Patent [19]

Nishide

[11] Patent Number: 4,565,737

[45] Date of Patent: Jan. 21, 1986

[54] HEAT-SENSITIVE TRANSFER MATERIAL

[75] Inventor: Katsuhiko Nishide, Yokohama, Japan

[73] Assignee: Canon Kabushiki Kaisha, Tokyo, Japan

[21] Appl. No.: 602,710

[22] Filed: Apr. 23, 1984

[30] Foreign Application Priority Data

May 2, 1983 [JP] Japan ..... 58-76178
May 2, 1983 [JP] Japan ..... 58-76179

[51] Int. Cl.[4] ..... B41M 5/26

[52] U.S. Cl. ..... 428/321.5; 428/207; 428/403; 428/488.1; 428/913; 428/914

[58] Field of Search ..... 428/321.5, 488.1, 913, 428/914, 195, 204, 207, 320.2, 321.1, 321.3, 323, 403

[56] References Cited

U.S. PATENT DOCUMENTS 3,317,433 5/1967 Eichel ..... 428/321.5

*Primary Examiner*—Bruce H. Hess
*Attorney, Agent, or Firm*—Fitzpatrick, Cella, Harper & Scinto

[57] ABSTRACT

A heat-sensitive transfer material is obtained by forming on a support a layer of heat-transferable ink comprising a heat-fusible binder, a colorant and a gas generating component capable of generating gas on heating. The gas generating component may be either a heat-decomposable foaming agent or a micro-particulate filler containing a readily volatile organic liquid. The heat-sensitive transfer material is adapted for printing on a paper having poor surface smoothness.

7 Claims, 2 Drawing Figures

HEAT-SENSITIVE TRANSFER MATERIAL

BACKGROUND OF THE INVENTION

1. Field of the Invention

This invention relates to a heat-sensitive transfer material, more particularly to a heat-sensitive transfer material which can give a transferred recorded image of good printed letter quality even on a recording medium with bad surface smoothness by incorporating a component capable of generating a gas on heating in the heat transferable ink layer.

2. Description of the Prior Art

With rapid progress of information industries, various information processing systems have been developed, and various recording methods and devices suited for the respective information processing systems have been developed and adopted. As one of such recording methods, the heat-sensitive recording method has recently been widely used because of various advantages such that the apparatus therefor is light in weight and compact, does not generate noise and also is excellent in operability and maintenance.

However, of the recording papers used for the heat-sensitive recording method, ordinary heat-sensitive recording papers are expensive since they are converted papers containing a color forming agent and a developing agent, and also involve the problems that alteration of the recording is possible, that the recording paper is susceptible to color formation by heat or organic solvents and that the storability of recording is poor, with the recorded image fading within a relatively short time.

As the method which maintains the advantages of the heat-sensitive recording method as described above and also compensates for the disadvantages with the use of heat-sensitive recording papers, the heat-sensitive transfer recording method is particularly attracting attention in these days.

In the heat-sensitive recording method a heat-sensitive transfer material is used, which comprises a layer of a heat-transferable ink containing a colorant dispersed in a heat-fusible binder coated by melting on a support generally in the form of a sheet, and the recording is generally conducted by superposing the heat-sensitive material on a recording medium such as paper so that the heat-transferable ink layer will contact the recording medium, supplying heat from the support side of the heat-sensitive transfer material by means of a thermal head to transfer the molten ink layer to the recording medium, thereby forming a transferred ink image corresponding to the heat supplying pattern on the recording medium. According to this method, the advantages of the heat-sensitive recording method as mentioned above can be maintained, and also the disadvantages with the use of the heat-sensitive recording paper can be eliminated.

However, the heat-sensitive transfer recording method of the prior art is not free from drawbacks. That is, according to the heat-sensitive transfer recording method of the prior art, the transfer recording performance, namely the printed letter quality is remarkably influenced by the surface smoothness of the recording medium, and therefore while good printing can be effected on a recording medium having high smoothness, the printed letter quality will be markedly lowered in the case of a paper with low smoothness. However, even when paper which is the most typical recording medium may be used, a paper with high smoothness is rather special and ordinary papers have surface unevenness to various extents because they are formed through entanglements of fibers. Accordingly, in the case of a paper with large surface unevenness, the molten ink cannot be made to penetrate into fibers during printing but attaches only on the convexties or in the vicinity thereof on the surface, whereby the resulting printed image may not be sharp at the edge portion, or a part of the image may be missing, reducing the printed letter quality. Also, for improvement of the printed letter quality, it may be considered to use a heat-fusible binder with a low melting point. In this case, however, the heat transferable ink layer becomes tacky also at a relatively low temperature, whereby inconveniences such as a reduction in storability and staining at the non-printed portion may occur.

SUMMARY OF THE INVENTION

An object of the present invention is to provide a heat-sensitive transfer material which can give printed letters of good quality not only on a recording medium having high surface smoothness but also on a recording medium having low surface smoothness.

Another object of the present invention is to provide a heat-sensitive transfer material excellent in storability.

Still another object of the present invention is to provide a heat-sensitive transfer material which does not cause staining at the non-printed portion on a recording medium.

The heat-sensitive transfer material according to the present invention comprises a support and a heat-transferable ink layer formed on the support, said heat-transferable ink layer containing a colorant and a gas generating component capable of generating gas on heating in a heat-fusible binder.

Thus, in order to accomplish the above objects of the present invention, it has been found very effective to have a gas generating component capable of generating a gas on heating dispersed in the heat-transferable ink layer. In the thus formed heat-transferable ink layer, it is rendered possible that the ink can penetrate into the interior of a recording medium. For this reason, even for a recording medium having poor smoothness, generation of defects in printed image can be prevented to enable improvement of printed letter quality. Also, the dispersion of the gas-generating component does not cause a lowering in the melting point of the heat-transferable ink layer as a whole or a decrease in storability before use.

The present invention will described in further detail below by referring to the drawings according to necessity. In the following description, "%" and "parts" representing proportions of amount are by weight unless specifically otherwise noted.

DETAILED DESCRIPTION OF THE PREFERRED EMBODIMENTS

Figure 1:
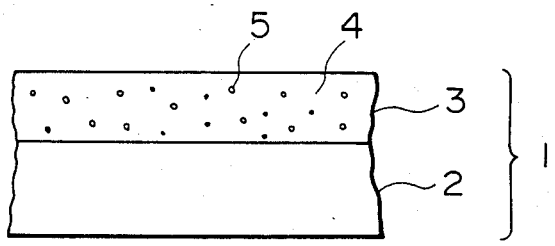
FIG. 1 is a schematic sectional view in the thickness direction of an embodiment of the heat-sensitive transfer material of the present invention.

FIG. 1 is a schematic sectional view in the thickness direction of the most basic embodiment of the heat-sensitive transfer material in the present invention. More specifically, the heat-sensitive transfer material 1 generally comprises a heat-transferable ink layer 3 formed on the support 2 in the form of a sheet ("'sheet" being used to include films).

As the support 2, it is possible to use films or papers known in the art as such. For example, films of plastics having relatively good heat resistance such as polyester, polycarbonate, triacetylcellulose, nylon, polyimide, etc., Cellophane or parchment paper can be preferably used. The support should have a thickness desirably of about 2 to 15 microns when considering the thermal head as the heat source during heat transfer, but it is not particularly limited when using a heating source capable of heating selectively the heat-transferable ink layer such as laser beam. Also, in the case of using a thermal head, the surface of the support to contact the thermal head can be provided with a heat-resistant protective layer comprising a silicone resin, a fluorine resin, a polyimide resin, an epoxy resin, a phenol resin, a melamine resin or nitrocellulose to improve the heat resistance of the support. Alternatively, a support material which could not be used in the prior art can also be used by provision of such a protective layer.

The heat-transferable ink layer 3 comprises a coated layer of a heat-fusible ink comprising a heat-fusible binder 4 containing a colorant dispersed or mixed compatibly therein, and a gas generating component 5 further dispersed in the heat-fusible binder.

The heat-fusible ink comprising a colorant and a heat-fusible binder may be one conventionally used in the heat-sensitive transfer material, which can be used as such. More specifically, as the colorant, various dyes, pigments or carbon black widely used in the field of printing or recording can be used. Useful heat-fusible binders may include waxes such as carnauba wax, paraffin wax, sazol wax, microcrystalline wax, castor wax and the like; higher fatty acids or derivatives thereof, for example, metal salts or esters thereof such as stearic acid, palmitic acid, lauric acid, aluminum stearate, lead stearate, barium stearate, zinc stearate, zinc palmitate, methylhydroxy stearate, glycerol monohydroxystearate and the like; thermoplastic resins comprising homopolymers or copolymers of olefins or their derivatives such as polyethylene, polypropylene, polyisobutylene, polyethylene wax, polyethylene oxide, polytetrafluoroethylene, ethylene-acrylic acid copolymer, ethylene-ethyl acrylate copolymer, ethylene-vinyl acetate copolymer and the like. These heat-fusible binders may be used either singly or as a mixture of two or more compounds.

The heat-fusible ink constituting the heat-transferable ink layer 3 comprises a gas generating component 5 dispersed in an ordinary heat-fusible ink as described above. The gas generating component to be used in the present invention is a component capable of generating a gas by the heat applied during heat transfer of ink, and, because the pressing force of the gas generated is utilized, it is more preferable to use a gas generating component of the kind which can generate larger amount of gas within a short time than the one with smaller amount of gas generation. Examples of such preferable gas generating components include heat decomposable foaming agents and microparticulate fillers containing or enclosing a readily volatile organic liquid therein.

As a heat decomposable foaming agent to be used in the present invention, there may be preferably employed a substance which can be chemically decomposed on heating to generate gas and also satisfy the following conditions:

(1) it can be stably dispersed or dissolved in the ink material (thus, in the present specification, the "dispersed" state of the heat decomposable foaming agent in the heat-fusible binder is also inclusive of the dissolved state);

(2) it should be stable at room temperature and can be decomposed at a temperature of 200° C or lower;

(3) the decomposed gas should not be corrosive or toxic;

(4) the decomposed gas should be free from objectionable odor or contaminating property; and (5) the agent itself or its decomposed residue should not react with the ink material to cause decoloration or denaturation.

For example, as inorganic foaming agents, there are bicarbonates such as sodium bicarbonate, ammonium bicarbonate and the like; carbonates such as ammonium carbonate, magnesium carbonate and the like; an equimolar mixture of sodium nitrite and ammcnium chloride; azide compounds such as $CaN_6$ or $BaN_6$; ferrous oxalate; ammonium persulfate; sodium borohydride; and so on. Examples of organic foaming agents are azo type foaming agents such as azodicarbonamide (ADCA), azobisisobutyronitrile (AIBN), diazoaminobenzene (DAB) and the like; nitroso type foaming agents such as N,N'-dinitrosopentaethylenetetramine (DPT or DNTD), N,N'-dimethyl-N,N-'-dinitroterephthalamide (DMDNTA) and the like; sulfonyl hydrazide type foaming agents such as p-toluenesulfonyl hydrazide (TSH), benzenesulfonyl hydrazide (BSH), p,p'-oxybisbenzenesulfonyl hydrazide and the like.

These inorganic foaming agents or organic foaming agents may be used either singly or as a mixture of two or more kinds in the same system or two or more kinds selected from both of the systems. If desired, a foaming aid may be also formulated in the foaming agent for the purpose of controlling the decomposition temperature of the foaming agent.

The foaming aid may be any compound having an action which can lower the decomposition temperature of the foaming agent employed when combined with the foaming agent, and depending on the foaming agent used, those enumerated below may be available. For example, there may be included oxalic acid, lactic acid, citric acid, succinic acid, malic acid, benzoic acid, salicylic acid, fumaric acid, malonic acid, adipic acid, gallic acid, toluenesulfonic acid, phosphoric acid, guanidine carbonate, ethanolamine, potassium carbonate, borax, boric acid, silicic acid, cadmium oxide, zinc oxide, zinc acetate, zinc chloride, zinc nitrate, zinc laurate, zinc powder, mercury acetate, mercury oxide, barium stearate, calcium stearate, magnesium oxide, calcium carbonate, lead carbonate, lead acetate, lead oxide, lead sulfate, dibasic phosphite, stannous oxide, Dexy-clay, dimethylformamide, aluminum stearate, titanium oxide, boron trifluoride, urea and so on. When there is a possibility of generation of a small amount of formaldehyde during heat decomposition as in the case of using an organic weak acid as the foaming aid, it is preferred to employ a compound having an action to capture formaldehyde such as urea in combination.

In the heat-transferable ink layer, it is preferred to disperse 30 parts or less of a heat decomposable foaming agent alone or in combination with a second foaming agent per 100 parts of the heat-fusible binder.

When a microparticulate filler containing a readily volatile organic liquid therein is used as a gas generating component, the readily volatile organic liquid is generally enclosed within the microparticulate material comprising a resin by impregnation or microencapsulation. As the readily volatile organic liquid, any of the compounds used in the field of resin treatment as the evaporation type foaming agent or the readily volatile foaming agent can be used as such also in the present invention. The readily volatile organic liquid may be chosen depending on the form enclosed within the microparticulate filler, but generally a compound which is liquid around normal temperature and normal pressure and has a boiling point of 130° C or lower, particularly 100° C. or lower, may preferably be used. Typical examples of the readily volatile organic liquid are set forth below:

(a) Aliphatic hydrocarbons:

For example, hydrocarbons having 4 to 7 carbon atoms such as n-propane, n-pentane, n-hexane, neopentane, isohexane, n-heptane, isoheptane and the like. These are low in toxicity and cheap.

(b) Chlorinated aliphatic hydrocarbons:

For example, methyl chloride, methylene dichloride, trichloroethylene, dichloroethane (sym), and the like.

(c) Fluorinated aliphatic hydrocarbons:

For example, chlorine-fluorine derivatives of methane or ethane such as Freon-11 ($CCl_3F$), Freon-12 ($CCl_2F_2$), Freon-21 ($CHCl_2F$), Freon-22 ($CHClF_2$), Freon-113 ($CCl_2F$-$CClF_2$), Freon-114 ($CClF_2$-$CClF_2$) are frequently used.

(d) Aromatic hydrocarbons:

Benzene, toluene and the like.

These microparticulate fillers containing readily volatile organic liquid therein can be prepared according to the resin impregnation method or the microencapsulation method known in the art. In the case of the resin impregnation method, it is possible to employ, for example, the method in which a readily volatile organic liquid is added during the process of suspension polymerization of an appropriate monomer (Japanese Patent Publication No. 3190/1958) or the method in which the beads obtained by suspension polymerization are swelled with a solvent and a readily volatile organic liquid is added thereto (Japanese Patent Publication No. 10628/1961). If desired, the resin may be micropulverized before impregnation with a readily volatile organic liquid.

The microencapsulation method is also inclusive of various methods such as the complex coacervation method, the interfacial polymerization method and the phase separation method known in the art. Various commercial products are available as microcapsules enclosing readily volatile organic liquid, such as Matsumoto Microsphere F30, F50, F60 produced by Matsumoto Yushi Seiyaku K.K. or Expancell produced by Nippon Philite K.K. (enclosing a foaming agent of isobutane within a wall material of vinylidene chloride/acrylonitrile copolymer).

Including those as described above, as the microparticulate filler material containing a readily volatile organic liquid, it is preferred to use one having particle sizes of 0.1 to 30 micron, particularly 0.1 to 10 micron, above all one with smaller particle sizes.

In the heat-transferable ink layer 3, it is preferred to disperse 50 parts or less of a microparticulate filler per 100 parts of the heat-fusible binder as described above.

The heat-sensitive transfer material 1 according to the present invention can be prepared by applying a coating solution composed mainly of the heat-fusible ink containing the heat-fusible binder, colorant and the gas-generating component as described above and drying the coating to form the heat-trans-ferable ink layer 3. The thickness of the heat-transferable ink layer 3 is generally 1 to 30 microns, preferably 2 to 20 microns.

The shape of the heat-sensitive transfer material of the present invention is not particularly limited as far as it is basically planar, but it is generally shaped in the form of a tape or ribbon as in a typewriter ribbon or a tape with wide width as used in line printers, etc. Also, for the purpose of color recording, the heat-sensitive transfer material of the inventions can be formed by applying several kinds or color tones of heat-fusible inks in stripes or blocks on a support.

Figure 2:
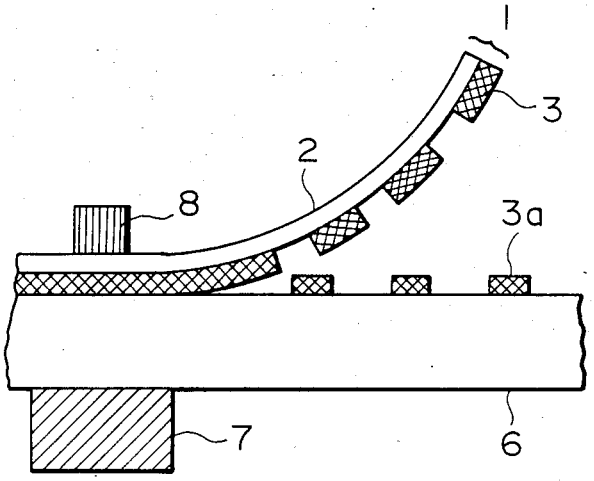
FIG. 2 is a schematic sectional view as seen in the thickness direction of a heat-sensitive transfer material for illustration of an embodiment of the heat-sensitive transfer recording method by use of the heat-sensitive transfer material shown in FIG. 1.

Next, the heat-sensitive transfer recording method employing the above heat-sensitive transfer material is described by referring to the case in which a thermal head is employed as the most typical heat source. FIG. 2 is a schematic sectional view in the thickness direction of the heat-sensitive transfer material showing its outline. More specifically, the heat-fusible ink 3 of the heat-sensitive transfer material 1 is caused to closely contact the recording medium, and while giving a heat pulse by means of the thermal head 8 with additional heat pulse, if desired, from the platen 7, the ink layer 3 is heated locally corresponding to the desired printing or transfer pattern. The heated portion of the ink layer 3 is softened or melted on reaching a certain temperature and, at almost the same time, the gas generating component is also heated to be decomposed with generation of a gas. By the volume expansion of the ink layer and the pressure of the gas, the ink can sufficiently penetrate into and fill even the concavities of the recording medium surface where a conventional heat transfer ink could not penetrate, thus giving a recorded image 3*a* of good printed letter quality even on the recording medium of poor surface smoothness.

The above description has been made by referring to an embodiment in which a thermal head is used as the heat source for heat transfer recording, but it will readily be understood that the method can be similarly practiced also in the case of using other heat sources such as a laser beam, etc.

As described in detail above, the heat transfer material of the present invention is capable of performing recording even on a recording medium with poor surface smoothness and yet no lowering in storability of the heat transfer material is brought about. Thus, it may be considered to be applicable widely for information recording system which is expected to be diversified in the future.

The present invention will be described more specifically by referring to actual example of production and use of heat-sensitive transfer materials.

EXAMPLE 1

One part of carbon black, one part of polyethylene wax (softening point: about 95° C.), 2 parts of paraffin wax (softening point: about 70° C.) and one part of carnauba wax were mixed by heating at 100° C. under stirring. Then, 25 parts of toluene were added to the mixture, and the mixture was heated at about 100° C. and thereafter cooled under vigorous stirring to room temperature to obtain a fine dispersion of carbon black-/wax in toluene.

In a ball mill, 0.5 part of ammonium carbonate and 5 parts of toluene were crushed together, and the resultant mixture was added to the fine dispersion of carbon black/wax in toluene as previously obtained, followed by vigorous stirring.

The above coating mixture was applied by means of a wire bar on a polyester film of a thickness of 6 μm and dried to obtain a heat-sensitive transfer material having a transfer layer of a thickness of 4 μm.

COMPARATIVE EXAMPLE 1

Only the fine dispersion of carbon black/wax in toluene of Example 1 was applied by means of a wire bar on a polyester film with a thickness of 6 μm and dried to obtain a heat-sensitive transfer material having a transfer layer of a thickness of 4 μm.

EXAMPLE 2

A heat-sensitive transfer material was prepared similarly as in Example 1 by replacing ammonium carbonate in Example 1 with calcium azide.

EAMPLE 3

To the fine dispersion of carbon black/wax in toluene produced in Example 1 was further added 0.5 part of azodicarbonamide and the mixture was further stirred in a ball mill. The resultant coating mixture was applied on a polyester film of a thickness of 6 μm and dried to obtain a heat-sensitive transfer material having·a transfer layer of a thickness of 4 μm.

EXAMPLE 4

Example 3 was repeated except for replacing 0.5 part of azodicarbonamide with 0.8 part of azobisisobutyronitrile to prepare a heat-sensitive transfer material.

EXAMPLE 5

To the fine dispersion of carbon black/wax in toluene produced in Example 1 were further added 0.5 part of azodicarbonamide and 0.03 part of ethanolamine, and following otherwise the same procedure of Example 3, a heat-sensitive transfer material was prepared.

By use of the various kinds of heat-sensitive transfer materials thus obtained, recording was effected on three kinds of recording paper with different Bekk smoothnesses according to a facsimile device of a heat-sensitive transfer type, and their resolutions were evaluated. As the original manuscript, an electrophotographic test chart was employed and the evaluation was conducted by measurement of resolution of images. The evaluation results are listed below.

| | Recording paper (Bekk smoothness) | | |
|---|---|---|---|
| Example No. | Bond paper (15 sec.) | High quality paper (30 sec.) | High quality (100 sec.) |
| Comparative Example 1 | Up to 3.6 lines/mm | Up to 4.5 lines/mm | Up to 6.3 lines/mm |
| Example 1 | Up to 5.6 lines/mm | Up to 6.3 lines/mm | Up to 6.3 lines/mm |
| Example 2 | Up to 5.6 lines/mm | " | Up to 6.3 lines/mm |
| Example 3 | Up to 5.6 lines/mm | " | Up to 6.3 lines/mm |

-continued

| | Recording paper (Bekk smoothness) | | |
|---|---|---|---|
| Example No. | Bond paper (15 sec.) | High quality paper (30 sec.) | High quality (100 sec.) |
| Example 4 | Up to 5.6 lines/mm | " | Up to 6.3 lines/mm |
| Example 5 | Up to 5.6 lines/mm | " | Up to 6.3 lines/mm |

EXAMPLE 6

One part of carbon black, 2 parts of polyethylene wax (softening point: 70° C.) and one part of carnauba wax were dispersed by mixing in an attritor by heating at about 100° C. Then, 30 parts of a petroleum solvent (trade name: Isopar H, produced by Esso) were added to the dispersion, and the mixture was heated at about 100° C and cooled under vigorous stirring to room temperature to obtain a fine dispersion of carbon black-/wax in Isopar H. Further, to the above dispersion was added one part of a microparticulate filler enclosing a readily volatile organic liquid (trade name: Microsphere F, produced by Matsumoto Yushi Seiyaku K.K.), followed by mixing under stirring, to obtain a coating mixture. The coating mixture was applied on a polyester film with a thickness of 6 micron and dried to obtain a heat-sensitive transfer material with a transfer ink layer of 10 micron in thickness.

By use of the above heat-sensitive transfer material, according to the heat-sensitive transfer type facsimile with an electrophotographic chart as the original manuscript, recording was performed on papers with different smoothnesses, and their resolutions were evaluated. As the result, a resolution of 6.3 lines/mm was obtained for a paper with Bekk smoothness of 100 sec., and 5.6 lines/mm for a paper with Bekk smoothness of 15 sec. Sharpness of the recorded image was good for each paper.

COMPARATIVE EXAMPLE 2

Only the fine dispersion of carbon black/wax in Isopar H of Example 6 was applied on a polyester film of a thickness of 6 micron and dried to obtain a heat-sensitive transfer paper of a thickness of the transfer ink layer of 10 microns.

By use of this heat-sensitive paper, heat-transfer recording and evaluation of resolution of the recorded image was conducted similarly as in Example 6. As the result, the resolution of 6.3 lines/mm was obtained for a paper with Bekk smoothness of 100 sec., but the resolution was lowered to 3.6 lines/mm for a paper of 15 sec., with the sharpness of the recorded image being also inferior.

EXAMPLE 7

Example 6 was repeated except for using fine particles of a polystyrene containing butane in place of the microsphere to obtain a heat-sensitive transfer material. With the use of this heat-sensitive transfer material, high resolution recording could be done similarly as in Example 6.

As apparently seen from the above results, when using the heat-sensitive transfer material of the present invention, lowering in resolution is very little even when the smoothness of the paper may be lowered. The recorded image obtained by using the heat-sensitive transfer material of Example 5 especially had a very good sharpness of recording. This may be attributable to closeness of the melting temperature of the heat-fusible ink to the decomposition temperature of the foaming agent, whereby the molten ink could be very effectively transferred.

What is claimed is:

1. A heat-sensitive transfer material comprising a support and a heat-transferable ink layer formed on said support, said heat-transferable ink layer comprising a heat-fusible binder, a colorant and a heat-decomposable foaming agent, said colorant and heat-decomposable foaming agent being dispersed in said heat-fusible binder, and said heat-decomposable foaming agent being contained in said heat-transferable ink layer in a proportion of 30 parts by weight or less per 100 parts by weight of said heat-fusible binder.

2. A heat-sensitive transfer material according to claim 1, wherein said heat-transferable ink layer further comprises a foaming aid, said heat-decomposable foaming agent and said foaming aid in combination being contained in a proportion of 30 parts by weight or less per 100 parts by weight of said heat-fusible binder.

3. A heat-sensitive transfer material according to claim 1, wherein said heat decomposable foaming agent can be decomposed at a temperature of 200° C. or lower.

4. A heat-sensitive transfer material comprising a support and a heat-transferable ink layer formed on said support, said heat-transferable ink layer comprising a heat-fusible binder, a colorant and a microparticulate filler containing a readily volatile organic liquid therein, said colorant and microparticulate filler being dispersed in said heat-fusible binder, and said microparticulate filler being contained in said heat-transferable ink layer in a proportion of 50 parts by weight or less per 100 parts by weight of said heat-fusible binder.

5. A heat-sensitive transfer material according to claim 1 wherein said readily volatile liquid has a boiling point of 130° C. or less.

6. A heat-sensitive transfer material according to claim 5, wherein the readily volatile liquid is contained in said microparticulate filler by impregnation.

7. A heat-sensitive transfer material according to claim 5, wherein the readily volatile liquid is contained in said microparticulate filler by microencapsulation.

* * * * *

UNITED STATES PATENT AND TRADEMARK OFFICE

CERTIFICATE OF CORRECTION

PATENT NO. : 4,565,737

DATED : January 21, 1986

INVENTOR(S) : KATSUHIKO NISHIDE

It is certified that error appears in the above-identified patent and that said Letters Patent is hereby corrected as shown below:

Col. 2, line 7, change "convexties" to --convexities--.

Col. 2, line 22, change "materiaI to --material--.

Col. 2, line 46, change "in printed" to --in a printed--.

Col. 2, line 52, change "will described" to --will be described--.

Col. 3, line 9, change ""(sheet" to --("sheet"--.

Col. 3, lines 9-10, change "used/to" to --used/herein to--.

Col. 4, line 27, change "ammcnium" to --ammonium--.

Col. 5, line 24, change "carbon" to --carbon--.

Col. 6, line 11, change "heat trans-ferable" to "heat-transferable--.

Col. 6, line 20, change "the inventions" to --the invention--.

Col. 10, line 16, change "claim 1" to --claim 4--.

Col. 10, line 19, change "the readily" to --said readily--.

Col. 10, line 22, " " " " " "

Signed and Sealed this

Twenty-eighth Day of October, 1986

[SEAL]

*Attest:*

DONALD J. QUIGG

*Attesting Officer* *Commissioner of Patents and Trademarks*